United States Patent [19]

Bakke

[11] 3,958,961

[45] May 25, 1976

[54] WET ELECTROSTATIC PRECIPITATORS

[75] Inventor: Even Bakke, New Providence, N.J.

[73] Assignee: United States Filter Corporation, New York, N.Y.

[22] Filed: Oct. 15, 1974

[21] Appl. No.: 514,973

Related U.S. Application Data

[62] Division of Ser. No. 329,269, Feb. 2, 1973.

[52] U.S. Cl. ..... 55/118; 23/260; 55/71; 55/73; 55/122; 55/126; 55/136; 55/228; 55/257 QV; 261/116; 261/117; 261/118

[51] Int. Cl.[2] ..... B03C 3/16

[58] Field of Search ..... 23/260; 55/73, 118, 55/71, 120, 124–126, 122, 129, 138, 136, 228, 257; 261/115–118

[56] References Cited

UNITED STATES PATENTS

| | | | |
|---|---|---|---|
| 2,874,802 | 2/1959 | Gustafsson et al. | 55/118 |
| 3,444,668 | 5/1969 | Masuda | 55/122 |
| 3,797,204 | 3/1974 | Cavatassi | 55/228 |

FOREIGN PATENTS OR APPLICATIONS

| | | | |
|---|---|---|---|
| 1,366,328 | 6/1964 | France | 55/126 |
| 891,839 | 11/1953 | Germany | 55/118 |
| 435,988 | 10/1926 | Germany | 55/128 |
| 125,681 | 4/1919 | United Kingdom | 55/118 |

*Primary Examiner*—Bernard Nozick

*Attorney, Agent, or Firm*—Blum, Moscovitz, Friedman & Kaplan

[57] ABSTRACT

A wet electrostatic precipitator has an inlet diffuser, a transverse electrostatic discharge section, an extended discharge section, a mist eliminator section and an outlet section. The inlet diffuses includes discharge electrodes interposed between collection plates extending in the direction of flow of gaseous feed and water sprays. The transverse discharge section includes baffles transverse to the direction of flow of the gaseous feed and water sprays. The extended discharge section includes transverse baffles and electrodes. The outlet section following the mist eliminator includes overlapped baffles.

11 Claims, 17 Drawing Figures

WET ELECTROSTATIC PRECIPITATORS

This is a division, of application Ser. No. 329,269, filed Feb. 2, 1973.

BACKGROUND OF THE INVENTION

This invention relates to electrostatic precipitators and, more particularly, to a new, improved and more efficient wet electrostatic precipitator.

Electrostatic precipitators are used for air pollution control, gas cleaning, separation, and particle removal. The fluid, such as a gaseous medium, flows under pressure between collection plates and discharge electrodes which latter are adapted to produce a corona and an electrostatic field when a sufficiently high voltage is applied thereto. Preferably the voltage is negative to produce a negative corona effect and an ionization.

Both positive and negative ions are generated in the corona, with the positive ions remaining on the negatively charged discharge electrode while the negative ions pass over to the grounded collection plates along the lines of force of the electrostatic field extending therebetween. The particles to be precipitated intercept the negative ions, are charged thereby, and are attracted to the adjacent collection plate. The fluid leaving the electrostatic precipitator moves on to recovery or exhaust.

Various means are utilized to periodically remove particles from the collection plates, among which may be mentioned intermittent spraying of the collection plates with water and rapping said plates with vibrators. However, although electrostatic precipitators of the mentioned type are highly efficient, an amount of charged and neutral particles generally escapes from the downstream side of the stack of alternating collection plates and discharge electrodes. Such particles either never reached the collection plates or were reentrained from the collection plates by the fluid flowing over the collection plates. These particles move with the fluid and experience has shown that the charged particles partially attach themselves to pipes and walls downstream of the collection plate area. Certain tarry precipitates adhere to the collection plates and cannot be removed by intermittent sprays or by rapping. The accumulation of such precipitates causes breakdown of the precipitator necessitating dismantling and manual cleaning thereof. Further, a dry electrostatic precipitator will not remove gases from the fluid medium. One way of assuring substantially complete collection and removal of all the particles and selective removal of gaseous contaminants from a flowing stream of fluid medium or the like without accumulation of precipitate on the collection plates is by using a so-called wet electrostatic precipitator (WEP).

SUMMARY OF THE INVENTION

In the application of a wet electrostatic precipitator, it is very important that the gas to be treated is saturated with water vapor to prevent evaporation of the washing water inside the precipitator which causes loss of washing water and dry zones on the internal members, where build up of particulates will occur. The saturation of the gas can be effected in a spray tower or scrubber upstream of the wet electrostatic precipitator, it can be effected in the inlet section thereof, or both arrangements can be used. The initial temperature of the gas and the saturation temperature dictate the method to be used.

In addition, it is also necessary to obtain a good and even velocity distribution across the wet electrostatic precipitator, and diffusion of gas from the duct velocity down to the wet electrostatic precipitator face velocity has to be performed in the inlet section. Furthermore, by spraying into the inlet section, some of the coarser particles will be removed and the gas absorption process, such as $SO_2$ removal, will be started.

In accordance with the invention, the inlet section or diffuser is provided with several sets of baffles in the form of transverse rows of vertically oriented channels which are spaced apart laterally a distance greater than their width, and which preferably are at a slight angle to the vertical, the successive rows being staggered relative to each other. The flanges of these channels extend upstream considered in the direction of the flow of fluid into the precipitator, and top sprays direct water to flow down the upstream faces of the channels. In addition, horizontal sprays of water are directed at the upstream surfaces of these baffles. The arrangement of the baffles results in what may be termed an "open" flow for the fluid into the precipitator.

Following the inlet diffuser, there are transverse electrostatic precipitator section in which collection plates, in the form of sets of baffles are arranged transverse to the direction of fluid flow, the respective sets of baffles being spaced in the direction of flow of the medium with a discharge electrode therebetween. Top sprays direct water to flow downwardly over the channel baffles, and horizontal sprays of water, directed in both directions relative to the flow of fluid are positioned both before and behind the transverse electrostatic precipitator section.

The transverse electrostatic precipitator sections are followed by another section containing a set of channel baffles, again providing an "open" flow, whose flanges are directed downstream with respect to the flow of gaseous medium or the like, and these baffles are associated with extended discharge electrodes of the main section, which comprises spaced parallel collection plates with the interposed discharge electrodes. The extended discharge electrodes project upstream from positions intermediate the main collection plates. A similar set of extended discharge electrodes project downstream facing a further set of baffles and are positioned at the downstream end of the main section. Vertical downstream sprays of water are applied to the main collection plate section. More than one of such main sections may be provided, with horizontal sprays and sets of baffles spaced for "open" flow between sections.

The extended discharge section is followed by a mist eliminator section in which two sets of transverse baffles or collection plates are spaced along the path of the medium with discharge electrodes positioned therebetween, the flanges of the channels extending toward the electrodes. This section is provided with means for intermittently applying a spray of water to the baffles to clean the same. The mist eliminator section is followed by a further set of baffles in the outlet section. All of the baffles following the extended discharge electrodes in the direction of fluid flow are so arranged as to overlap in successive rows. For example, the transverse spacing of the baffles may be the same as the width of each baffle. The final baffle set in the outlet section of the precipitator minimizes the so-called sweeping effect when the gas in the main housing converges toward the outlet duct or stack.

An object of the invention is to provide an improved electrostatic precipitator.

Another object of the invention is to provide an improved wet electrostatic precipitator for highly efficient removal of particles and selective removal of gaseous contaminants.

A further object of the invention is to provide such an improved wet electrostatic precipitator having continuously washed baffles in an inlet diffuser for effectively removing large particles of material from an entering stream of fluid, for selective absorption of gaseous contaminants and for full saturation of the fluid medium.

Another object of the invention is to provide such an improved wet electrostatic precipitator in which baffles in various sections are continuously washed with vertical and horizontal streams of water.

Another object of the invention is to provide such a precipitator in which the baffles in advance of the main electrostatic precipitator section or sections are spaced sufficiently far apart to provide an "open" flow of fluid therebetween.

A further object of the invention is to provide such a wet electrostatic precipitator including an improved mist eliminator section in advance of an outlet section.

Still other objects and advantages of the invention will in part be obvious and will in part be apparent from the following specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
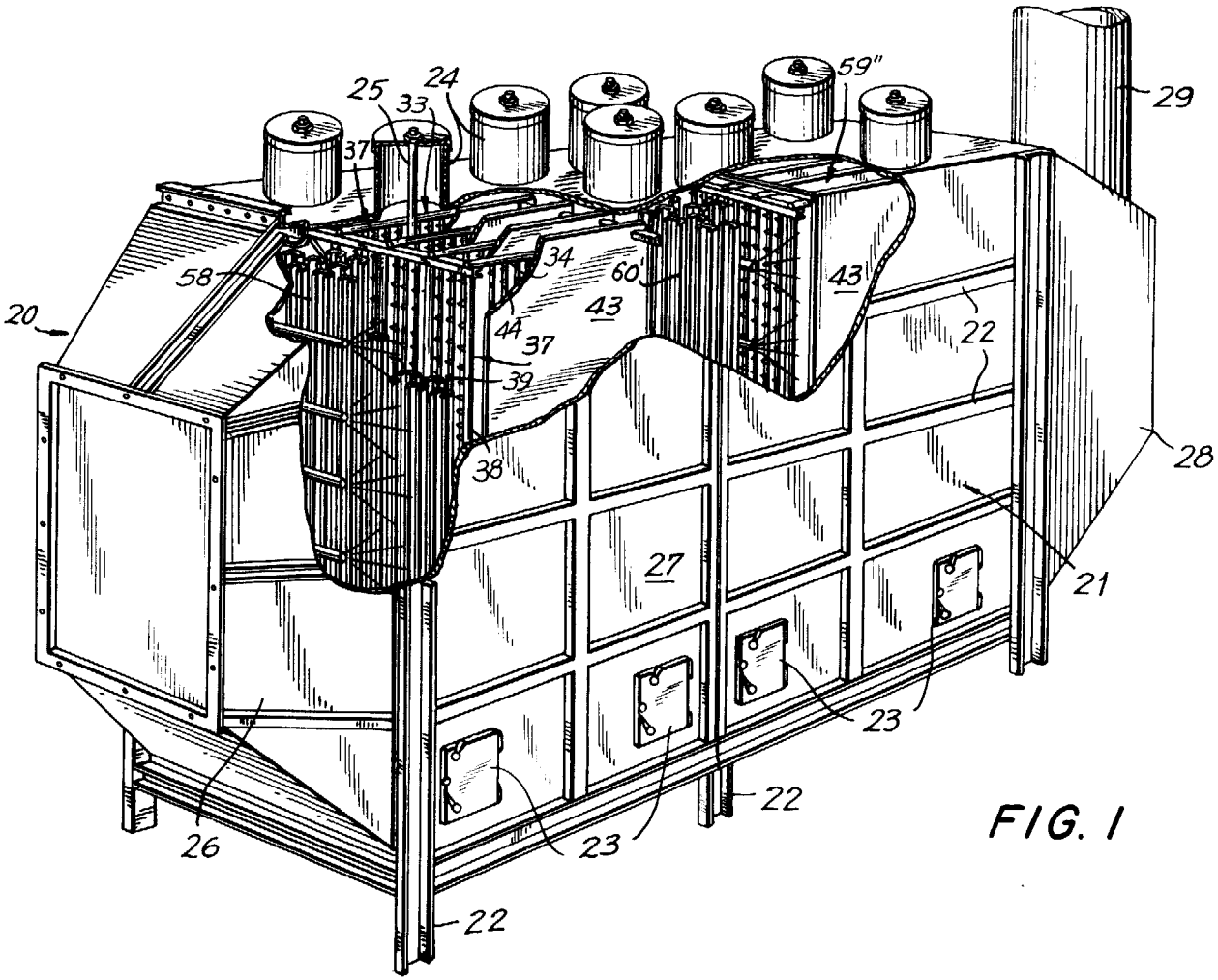
FIG. 1 is an exterior perspective view, partly broken away and partly in section, of a wet electrostatic precipitator embodying the invention.
Figure 2:
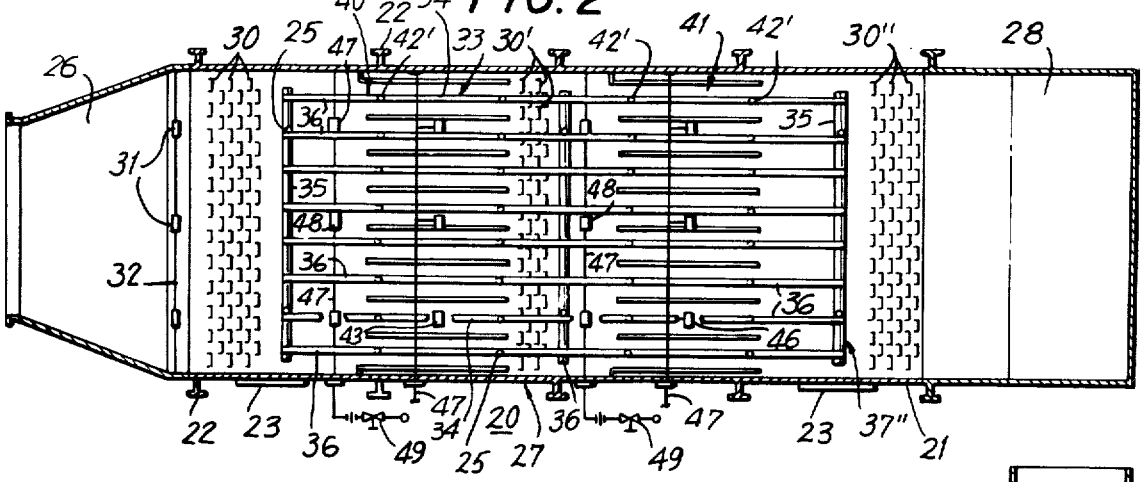
FIG. 2 is a horizontal sectional view through the wet electrostatic precipitator.
Figure 3:
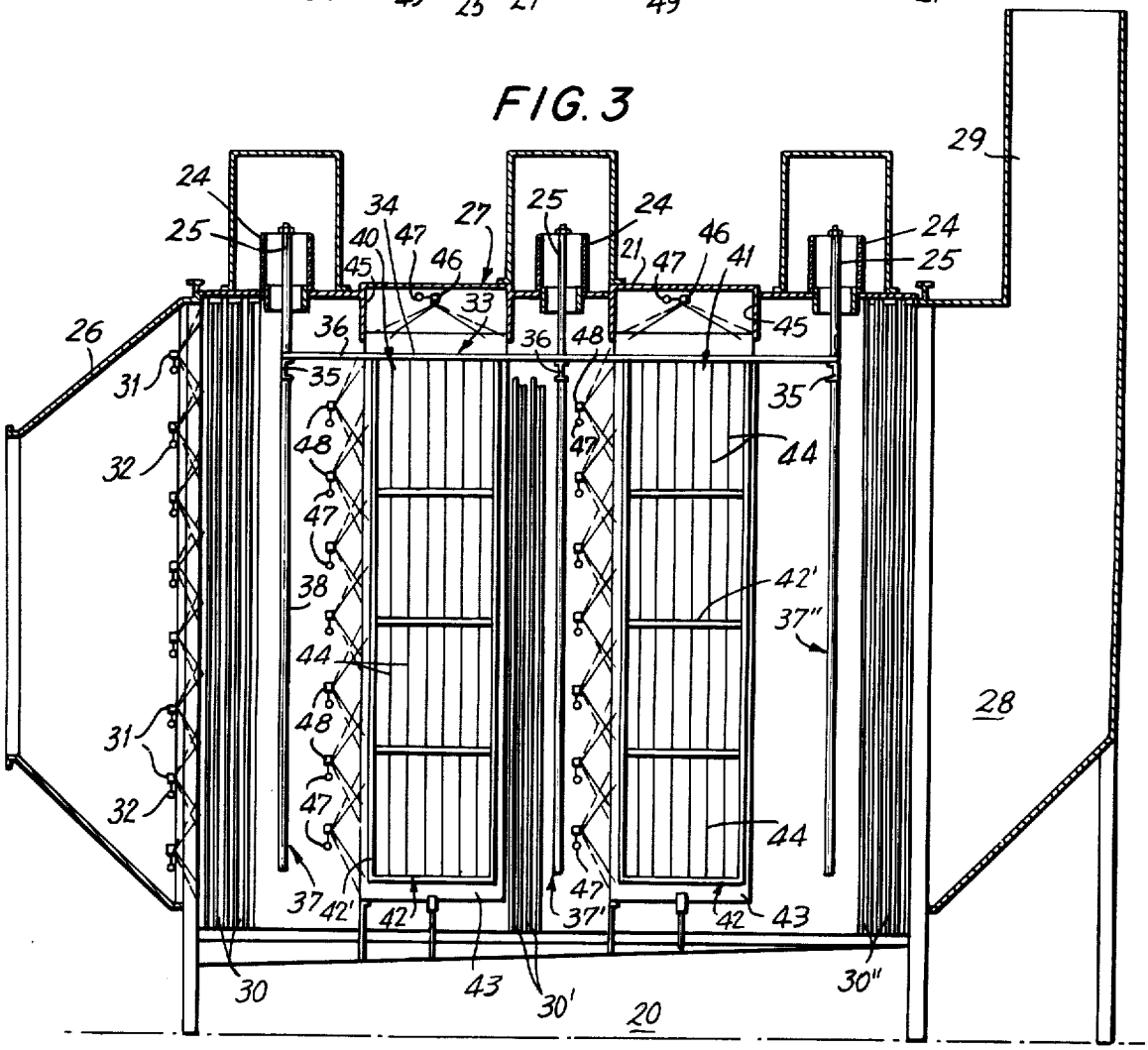
FIG. 3 is a vertical longitudinal sectional view through the wet electrostatic precipitator.

Referring first to FIGS. 1, 2 and 3, the wet electrostatic precipitator generally illustrated at 20 comprises a casing 21 reinforced by structural members 22 and having doors 23 in its side walls near the bottom for the removal of particulate material and for inspection, access and the like. Tubular insulators 24 on the top wall of casing 21 support electrically conductive rods or buses 25 connected to the discharge electrodes. Casing 21 forms an inlet section or diffuser 26 for the entering fluid, such as a gaseous medium, a main housing 27 for the electrostatic precipitator, and an outlet section 28 leading to a discharge stack 29.

In the embodiment of the invention shown in FIGS. 1, 2 and 3, as the gaseous medium or the like carrying the material to be precipitated enters main housing 27, it encounters a set of baffles 30 which are in the form of vertically oriented channels having their legs or flanges facing upstream of the flow of fluid entering the precipitator. The baffles 30 are arranged in several rows and the baffles in each row are spaced apart substantially by the width of the channels. For example, the channels may be 4 inches wide and be spaced apart 4 inches laterally of the precipitator. From FIG. 2, it will be noted that the baffles of each succeeding row are arranged opposite the open spaces in the immediately preceding row. The set of baffles 30 are continually sprayed from upstream with water from a plurality of nozzles 31 connected to vertically spaced, horizontally extending headers 32. Nozzles 31 are adapted to produce sprays in the form of droplets of water rather than in the form of streams of water. The baffles 30, upon which the entering gaseous medium impinges and by which it is deflected, remove large particles from the entering gaseous medium as the medium is caused to follow a relatively tortuous path by virtue of the deflecting baffles 30. The water also serves to absorb certain gases such as water-soluble gaseous fluorides.

High potential conductive rods or buses 25 are electrically and mechanically connected to a discharge electrode frame structure 33 including upper horizontally extending tubular frame elements 34. Said horizontally extending tubular frame elements 34 are joined by laterally extending channel-shaped beams 35 at the ends thereof and an I beam 36 in the center thereof. Suspended from the upstream channel-shaped beam 35 is an extended discharge electrode assembly 36. As shown in FIG. 1, said discharge electrode assembly consists of a tubular frame 38 supporting, together with beam 35, a series of vertically extending discharge electrodes 39 adapted to produce an electrostatic field extending substantially along the path of the gaseous medium as will be described in greater detail below. Extended discharge electrode assembly 37 serves to impart a precharge to the entering particulate material, effecting some initial precipitation thereof on the back side of baffles 30. The back sides of said baffles are washed by the droplets of water also precipitated on the back sides thereof due to the electrostatic field produced by extended discharge electrode assembly 37. Similarly constructed extended discharge assemblies 37' and 37'' are respectively mounted on I beam 36 and the downstream channel-shaped beam 35. Tubular frame 38 is substantially rectangular having horizontally extending tubular cross members vertically spaced therealong for providing support for discharge electrodes 39. The discharge electrodes are formed from laterally spaced, vertically extending metal strips mounted welded on frame 38, said strips being aligned in parallel planes extending perpendicular to the general plane of frame 38. In the embodiment depicted, the strips have their longitudinal edges formed with charge concentration points defined by projecting spikes. Discharge electrodes formed of other constructions, such as wires having barbs mounted thereon, vertically extending metal electrode strips formed with notches in the longitudinal edges thereof, or the like may be utilized.

The pre-charged fluid passing through the first extended discharge electrode assembly 37 enters the first of two main, parallel plate electrostatic precipitator sections 40 and 41 included within main housing 27 of the precipitator. Each of said plate sections consists of alternating discharge electrode assemblies 42 and grounded collection plates 43. Each discharge electrode assembly 42 consists of a tubular frame 42' supported on and electrically connected to horizontally extending frame elements 34. Said frame is substantially rectangular in configuration having vertically spaced horizontally extending cross members and supporting vertically extending discharge electrodes 44. Each of said discharge electrode assemblies extends in a plane substantially parallel to the path of the gaseous medium and is substantially equally spaced from each of the adjacent pair of collection plates 43. Said collection plates are preferably provided with a smooth surface.

Above each plate section 40, 41 there is formed a series of compartments 45, each of which contains a nozzle 46 connected to a header 47 and arranged to direct water, in the form of a spray of droplets, downwardly along the collection plates 43, this affording continuous washing of the collection plates. Also, in advance of each section 40 and 41 there is a series of vertically spaced horizontally extending headers 47 provided with nozzles 48 and supplied with water through control valves 49. Nozzles 48 spray water, in the form of sprays of droplets, through each plate section 40 and 41 in the direction of flow. Thus, the collection plates 43 are continually washed with water directed in the direction of flow with the gaseous medium and with water directed vertical downwardly therealong. In the embodiment depicted, all of nozzles 31, 46 and 48 produces a spray of water droplets in a hollow cone configuration but other spray configurations may be used.

The fluid medium passing through the precipitator, after passing through the first plate section 40, impinges against a second set of baffles in the form of vertically extending and laterally spaced channels 30'. The second set of baffles 30' is essentially similar to the first set of baffles 30, but there may be a lesser number of rows of baffles 30'. For example, while the baffles 30 are arranged in six rows, the baffles 30' may comprise only four rows. The fluid medium striking the baffles 30' are deflected thereby to flow in a tortuous path, resulting in further separation of particulate material from the fluid medium. The legs or flanges of channels 30' extend upstream in the same manner as do the legs or flanges of channels 30.

After passing by the channels 30', the fluid medium passes through second extended discharge electrode assembly 37', essentially identical with first extended discharge assembly 37. A further charge is imparted to the fluid medium by said second extended discharge electrode assembly, after which the fluid medium flows through the second plate section 41, resulting in further removal of fine particulate material from the fluid medium. The fluid medium then passes through a third extended discharge electrode assembly 37'' which imparts a charge on such particles as may escape from the main parallel plate sections or be reentrained therefrom.

After passing through the third extended discharge electrode assembly 37'', the fluid medium impinges against a third set of baffles comprising channels 30'' which extend vertically and are spaced apart laterally in the same manner as the channels 30, the set of channels 30'' being essentially similar to the set of channels 30, with their flanges extending upstream of the direction of fluid flow. The lateral and longitudinal spacing of the channels of the three sets 30, 30' and 30'' are substantially identical with each other. After passing through the channels 30'', substantially all of the particulate material has been removed from the fluid medium, and the latter then flows into outlet section 28 and out through discharge stack 29. The directional charge imparted on the particles escaping from second parallel plate section 41 causes such particles to be captured by channels 30'', which are grounded.

Figure 4:
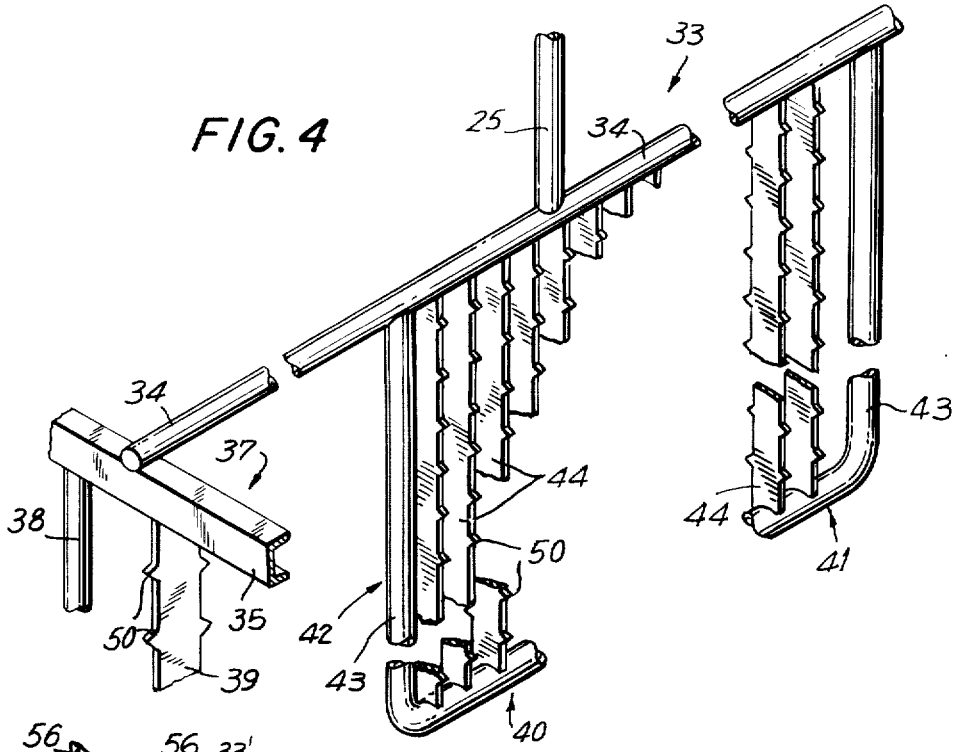
FIG. 4 is a perspective view, partly broken away, of discharge electrodes utilized in the precipitator.

A more detailed showing of discharge electrode frame structure 33 is depicted in FIG. 4. The entire structure is electrically coupled and a large voltage, sufficient to produce corona discharge at points 50, is applied thereto, the collection plates and baffles all being grounded. The discharge electrodes 44 and 39 may take any desired form such as wires, wires with barbs, notched bars or the like.

Figure 5:
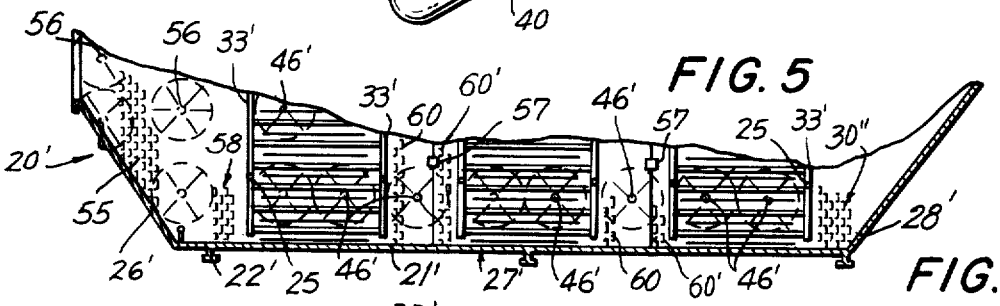
FIG. 5 is a partial horizontal sectional view of another wet electrostatic precipitator embodying the invention.
Figure 6:
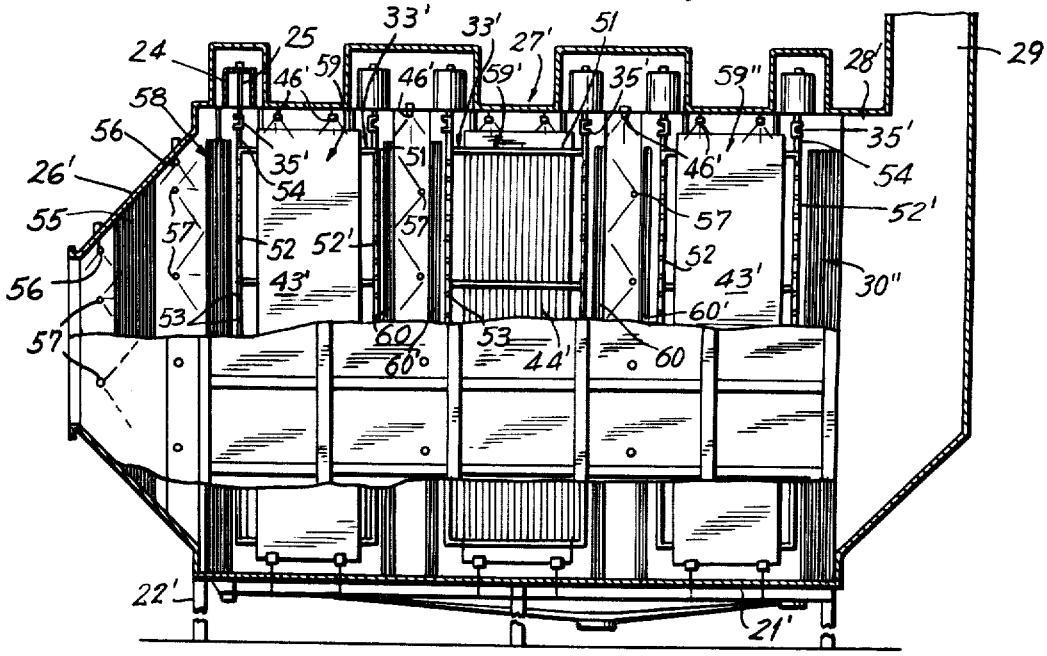
FIG. 6 is a longitudinal vertical sectional view, partly in elevation, corresponding to FIG. 5.

FIGS. 5 and 6 illustrate a modification of the invention in which parts identical with those in FIGS. 1, 2 and 3 have been given the same reference numerals and parts substantially similar to those in FIGS. 1, 2 and 3 have been given the same reference numerals primed. Referring to FIGS. 5 and 6, the wet electrostatic precipitator 20' illustrated therein again includes a casing 21' braced by structural members 22' and having insulators 24 supporting conductive busses or bars 25. Casing 21' is divided into an inlet section 26', a main section 27' an outlet section 28' and a stack 29.

In this embodiment of the invention, a first set of vertically extending channels or baffles 55 is arranged directly in the inlet diffuser section 26' and comprises several rows of transversely spaced vertically extending channels which are spaced apart a distance equal to or less than their widths, with the channels in each succeeding row overlapping the openings in the immediately preceding row. Also, vertical spray nozzles 56 are arranged along the upper wall of inlet section 26' both upstream and downstream of the channels 55 so as to spray water, in the form of droplet sprays, against both the upstream and downstream surfaces of the channels 55. Vertically spaced horizontal headers 57, arranged upstream of the channels 55, have spray nozzles directing sprays of water against the upstream surfaces of the set of channels 55 and in the direction of flow of gaseous medium through the precipitator. Headers 57 are also arranged downstream of the channels 55 and direct horizontal sprays of water, in the direction of fluid flow, against the set of baffles 58 arranged in advance of the first precipitator section 59. Thus, the sets of channels 55 and 58 have streams of water continuously sprayed downwardly therealong and horizontally thereagainst.

In this embodiment of the invention, there are three precipitator sections 59, 59' and 59'' arranged in series. The three sections are essentially identical, each including a discharge electrode frame structure 33'. The frame structure includes laterally extending channel-shaped beams 35' which extend laterally within main section 27' and are secured to and electrically connected to conductive busses 25. A series of rectangular tubular frames 51 having horizontally extending cross bars vertically spaced therein is mounted on and electrically coupled to each pair of beams 35' by means of tubular connecting rods 54. Each of the frames 51 supports vertically extending discharge electrodes 44' as depicted in section 59'. Discharge electrodes 44' are structured in the same manner as discharge electrodes 44 illustrated in FIG. 4. In registration with discharge electrodes 44' and extending parallel to frames 51 are parallel collection plates 43'. The collection plates are grounded and are positioned in spaced relation with one of frames 51 positioned intermediate each adjacent pair. The horizontally extending, tubular side portions 52 and 52' of each frame 51 defines an extended discharge electrode assembly. Spikes 53 are mounted in vertically spaced relation on the outer edge of each of supports 52 and 52', the spikes on support 52 facing upstream, the spikes on support 52' facing downstream. Each of these extended discharge electrode assemblies could be replaced by an extended discharge electrode assembly constructed in the same manner as extended discharge assembly 37 of the embodiment of FIGS. 1, 2 and 3.

Two rows of vertical spray nozzles 46' are arranged above the collection plates and electrodes of each of these sections 59, 59' and 59'', to spray water continuously downwardly along the collection plates. Each of said sections consists of an upstream-facing extended discharge section, a central parallel plate precipitator section and a downstream-facing extended discharge section. The extended discharge electrode assemblies 52' of the first and second sections 59 and 59' are each followed by channel-shaped baffle sets 60, said baffle sets being substantially identical to sets 55 and 58, except that they comprise only two rows of channels. A further channel set 60' is positioned adjacent each upstream-facing extended discharge assembly 52 of the second and third sections 59' and 59''. Between each pair of sets of channels 60 and 60', intermediate the main precipitator sections, further vertical spray nozzles 46' direct sprays of water continuously downwardly and sets of horizontal headers 57 direct sprays of water horizontally in the upstream direction between and along the collection plates. Intermediate extended discharge electrode assembly 52' of section 59'' and outlet section 28' are a final set of channel-shaped baffles 30'' positioned and structured in a manner similar to the corresponding baffles in the embodiment of FIGS. 1, 2 and 3.

Figure 8:
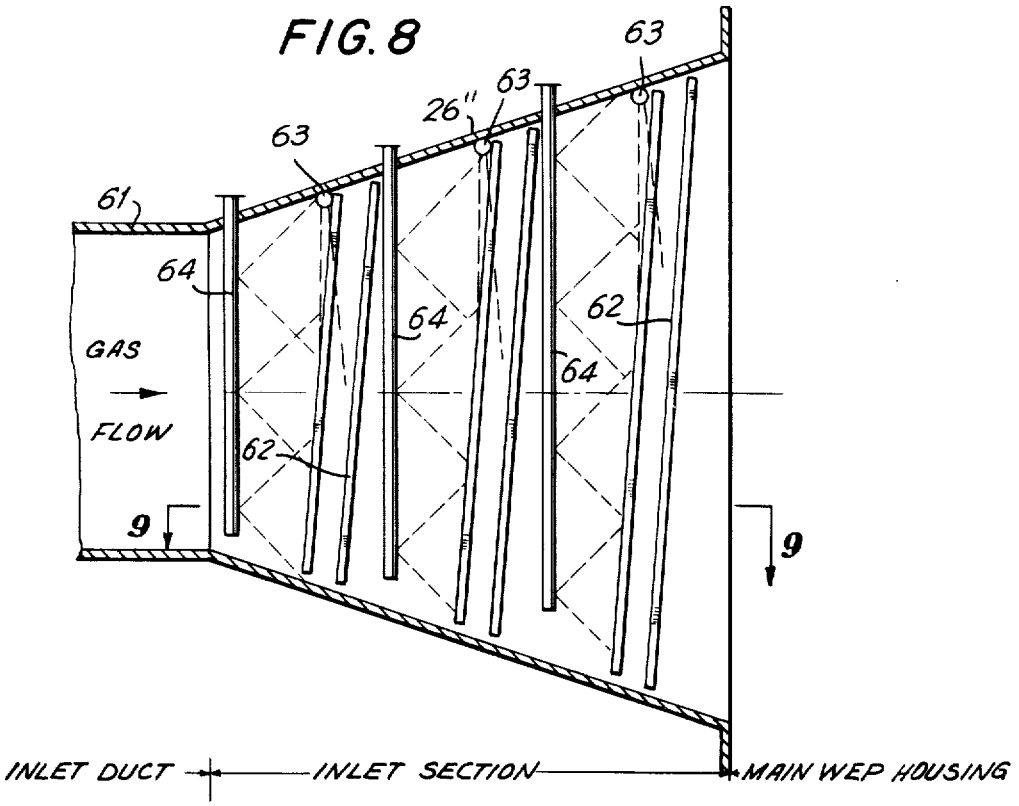
FIG. 8 is an enlarged partial sectional view of the inlet section or inlet diffuser of a precipitator embodying the invention.
Figure 9:
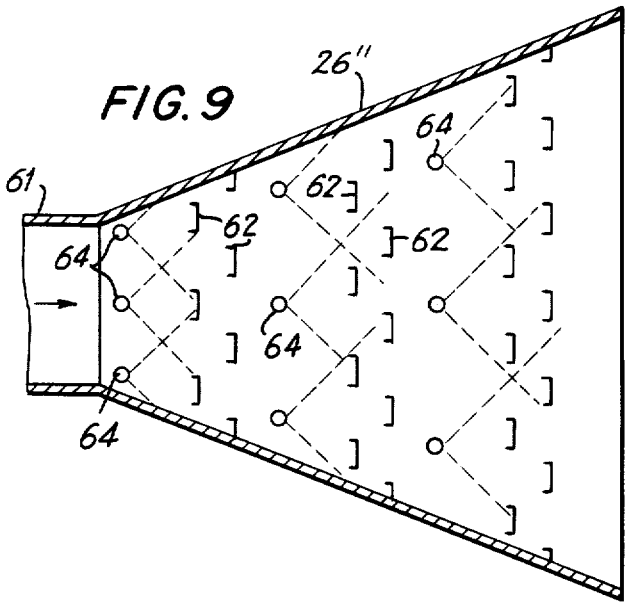
FIG. 9 is a horizontal sectional view taken on the line 9 — 9 of FIG. 8.

Before discussing the overall plant layout shown in FIG. 7, reference will be made to FIGS. 8 through 15 which illustrate the novel features of preferred embodiments of the invention. FIGS. 8 and 9 illustrate a preferred arrangement of the internal members or components of an inlet section 26'' receiving gaseous medium or the like through a conduit 61 through which the gas flows in the direction indicated by the arrows in FIGS 8 and 9. The purpose of the baffles 62 is to distribute the flow, act as contact zones between the unsaturated gas and the liquid, act as contact zones for gaseous absorption, and provide points of impaction for removal of coarser dust particles. Thereby, the inlet loading of dust to the wet electrostatic precipitator is reduced. As shown in FIG. 9, in each row baffles 62 have a transverse individual spacing larger than the width of a single baffle, or, stated another way, the baffles have been "opened" up transversely to provide an "open" configuration. This configuration provides a balanced effect of efficient gas distribution with the creation of a minimum amount of turbulence, and provides a certain amount of carry through of water drops for washing of the back sides of the baffles, and further gas saturation and gaseous contaminate absorption downstream of each baffle section. It will be noted that legs or flanges of the channels face upstream. Typically, with two rows of baffle and a gas space velocity of 2.5 ft/sec., if a spray puts in 100% of water, 49% will be collected on the upstream faces of the baffles, 9% on the downstream faces of the baffles and 42% will be carried through with the gas stream. The arrangement of the baffles with their flanges pointing upstream, as shown in FIGS. 8 and 9, increases the particulate collection efficiency. It will be noted that the baffles 62 are arranged in three sets, each comprising two rows of baffles.

The baffles typically are 2 inches wide with ¼ inch flanges, spaced 4 inches apart transversely, and with each row spaced 2 inches apart longitudinally from the back of the first row of baffles to the front edges of the flanges on the second row of baffles. This provides an open area, for gas passage, of 33% of the full cross sectional area.

The second section of two rows of baffles, as shown in FIG. 9, is offset 1.5 inches transversely as compared to the first section, and similarly with the third section of two rows of baffles, to obstruct any straight flow path through the section of baffles which the dust particles or water drops could take.

FIGS. 8 and 9 also show the spray configuration, and the spray intensity as dictated by the inlet grain loading. The spraying is effected by a combination of nozzle bearing headers 63 spraying downwardly from the top and nozzle bearing headers 64 spraying in the downstream direction directly on to the faces of the baffles 62 in each section. The water washes the baffles efficiently, since the water is constrained by the flanges of the channel shaped baffles to flow straight down the baffles. This minimizes channeling of the water and provides a continuous sheet of water covering the baffle surfaces. As will be noted particularly from FIG. 8, each baffle section of two rows of baffles 62 is installed a few degrees offset from the vertical to provide the best drainage of the water down the baffles.

When the inlet loading of dust is high, there is a potential hazard of build-up of material on the internal collection members, because of inadequate washing. However, it has been found that a transverse electrostatic precipitator section 65, shown in FIGS. 10 and 11, can be washed very efficiently and that one or two of these sections will remove a substantial amount of the coarser dust particles thereby to reduce the washing load in the parallel plate sections downstream of the transverse electrode sections. Those gaseous contaminates which can be absorbed in the liquid used will also be removed.

Figure 11:
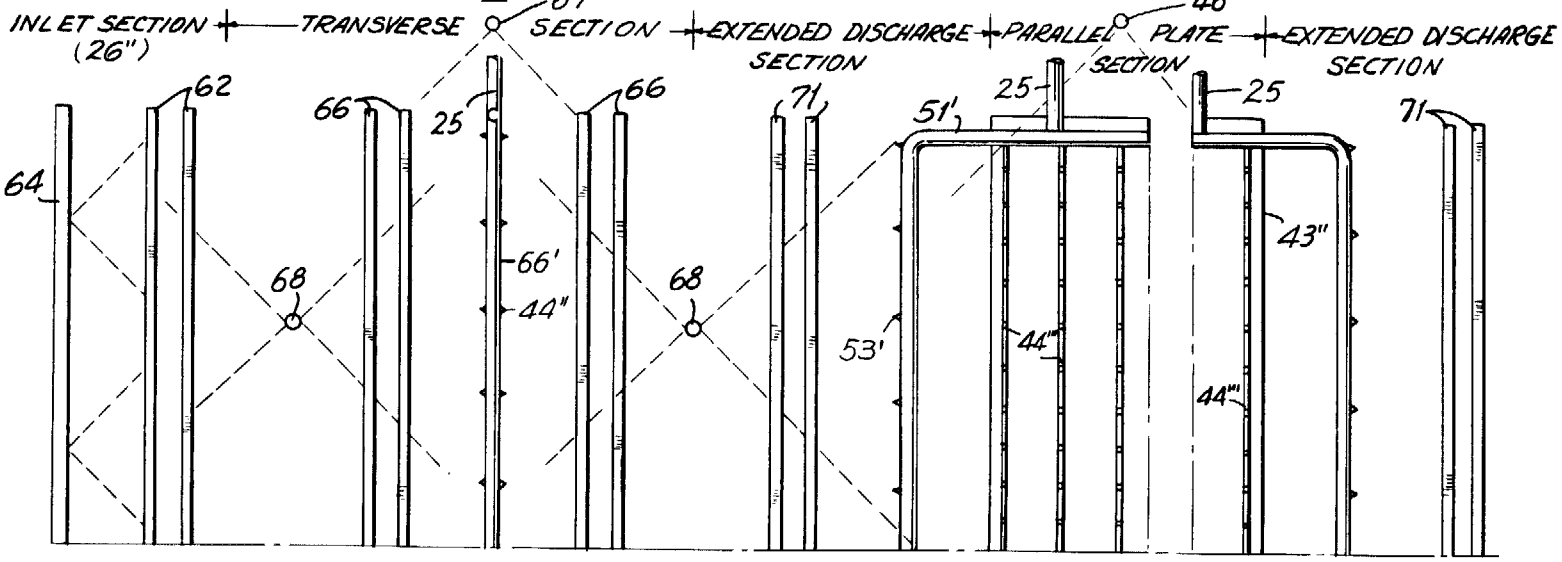
FIG. 11 is an elevation view corresponding to FIG. 10.

Each transverse section contains discharge electrode assembly 66' consisting of a rectangular tubular frame supporting discharge electrodes 44''. The frame is aligned transverse to the path of the medium with the electrodes of the plate type aligned essentially parallel to said path. The electrode assembly is positioned between two sets of facing baffles or grounded collection plates 66. Most of the washing of said baffles takes place from the top from spray nozzles 67 pointing vertically downwardly. However, by using the "open" baffle configuration for the channel-shaped baffles 66 in transverse section 65 the horizontal spray nozzles 68 can be placed further down from the top, as shown in FIG. 11, with the nozzles 68 ahead of section 65 spraying downstream and those at the exit of section 65 spraying upstream. A substantial fraction of the water sprayed will penetrade through the "open" baffle section and wash the baffle surfaces facing the electrodes. This results from the fact that the liquid drops will take an electrostatic charge, and at least a portion of the smaller drops, those less than 80 microns, will migrate to the collection baffles and wash all particles that also have migrated to the baffles 66, as shown by the dashed arrows. Larger drops will hit the baffles 66 by impaction, or fall through the section and down into the trough.

Figure 10:
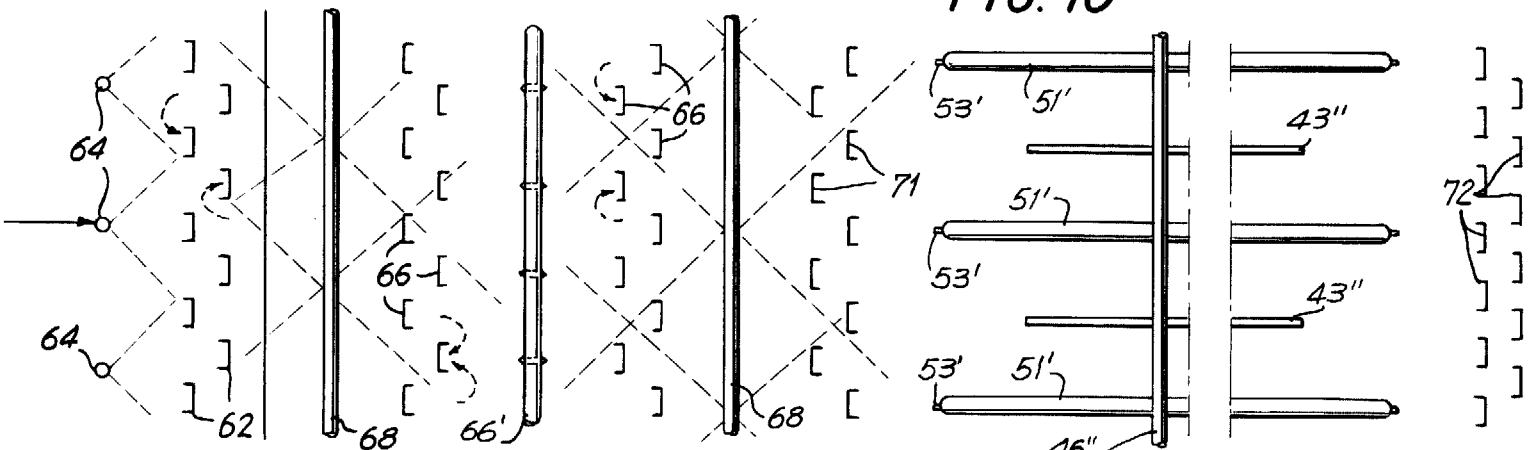
FIG. 10 is a plan view illustrating the inlet section, the transverse section, the extended discharge section and the main parallel plate section of the wet electrostatic precipitator, the inlet section of which is pictured in FIG. 8.

The two rows of baffles 66 upstream and downstream of discharge electrode assembly 66' act as gas distribution devices and tend to remove any skewed velocity profile that the baffles 62 in the inlet section 26' could not remove. This is accomplished with the introduction of a minimum amount of turbulence. The flanges of both the upstream and downstream baffles 66 point toward the electrode assembly 66', as seen in FIG. 10. This has been found to be the best configuration because the turbulence will be lowest in the electrostatic field zone and the discharge of ions will be the highest.

Baffles 66 typically are 2 inches wide with ¼ inch flanges, and are spaced 4 inches apart transversely. The second row of baffles is spaced 2 inches downstream from the first row and aligned to be centered in the space between the first row of baffles, providing an open area of 33% of the full cross sectional area.

Figure 13:
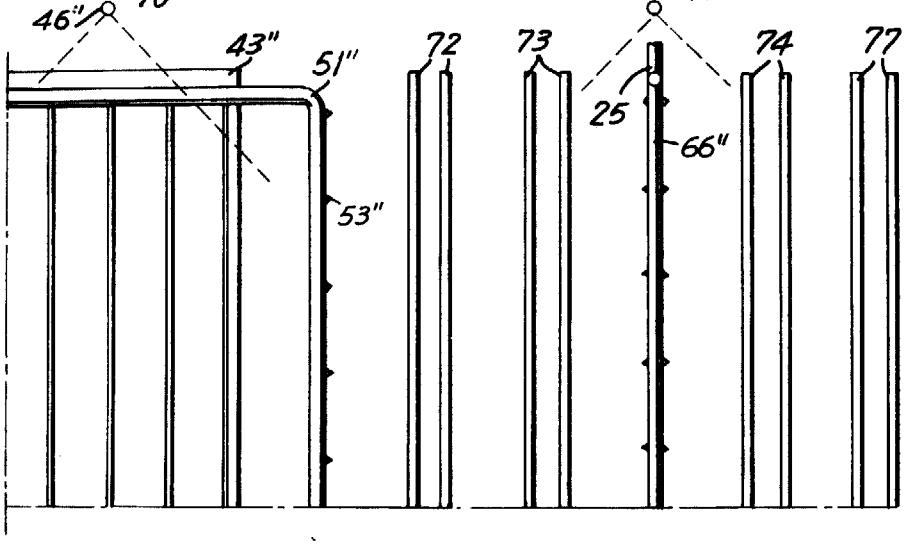
FIG. 13 is an elevation view corresponding to FIG. 12.
Figure 14:
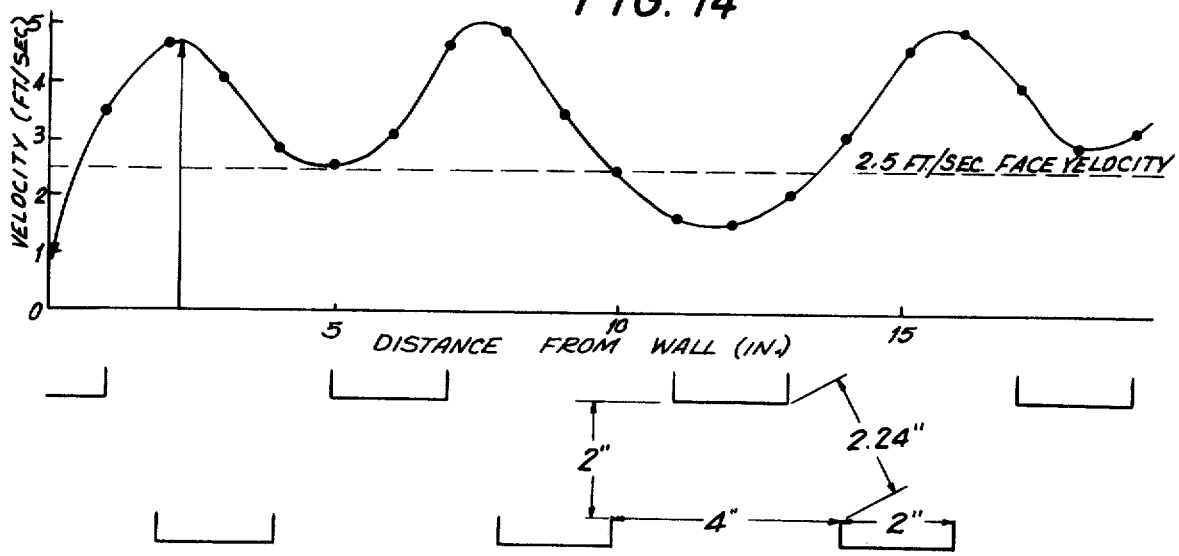
FIGS. 14 and 15 are curves illustrating the velocity profile through the precipitator using "open" baffles as compared to "closed" baffles of larger size and closer spacing.
Figure 15:
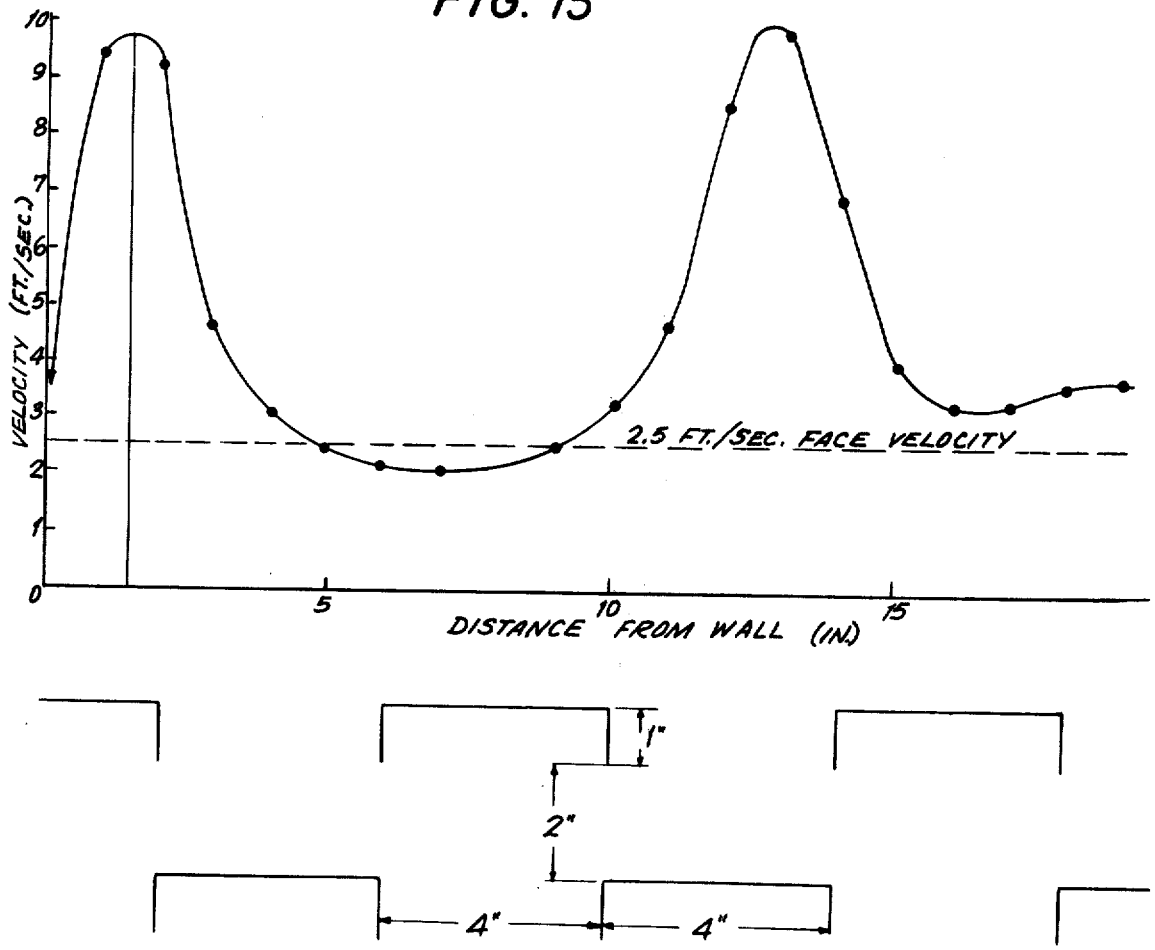

The baffles utilized in the embodiments of FIGS. 1–6 do not have the "open" construction being, in one case, 4 inches wide with 4 inch transverse spacing, with the rows spaced 2 inches apart in the direction of gas flow. However, it has been found that these baffles introduce considerable turbulence, so that the downstream surfaces of the baffles can be washed only from the top by nozzles pointing vertically downwardly. The 2 inch channels, used in the open configuration as mentioned above, have distinct advantages with respect to the velocity distribution downstream thereof. The spray from nozzles directed along the flow path either upstream or downstream can penetrate between the baffles and migrate to the surfaces thereof facing away from the nozzles for effective cleaning of said nozzles and improved contact between the medium and the sprayed liquid. FIGS. 14 and 15 show, by way of example, the velocity distribution downstream of the 2 inch baffles, with an "open" configuration, and the 4 inch baffles in the "closed" configuration, respectively. Behind each opening between the baffles of the last rows, there is a velocity peak, and behind each baffle in the last row there is a minimum velocity point. The relative difference in the minimum and maximum velocity is an indication of the turbulence or local disturbance to the gas flow past the baffles. From FIG. 13 it can be seen that, with a face velocity of 2.5 ft/sec., the velocity span for the 4 inch baffles was from 1.0 ft/sec. to 10.0 ft/sec. From FIG. 14, it can be seen that the velocity span for the 2 inch spaced baffles is from 1.6 ft/sec. to 5.0 ft/sec. Thus, the maximum velocity was reduced by 50% by using the 2 inch baffles with a 4 inch transverse spacing. The turbulence caused by the "closed up" construction can cause reentrainment of precipitant, and even prevent precipitation, leading to inefficient precipitation.

Referring specifically to the baffles 66 of the transverse precipitator section 65, the width and spacing of these baffles must be such that inertial forces due to turbulence in this section do not overcome the electrostatic force and prevent capture of a portion of the particles which would otherwise be precipitated. Flow in the region of baffles 66 characterized by a Reynolds number less than 5,000 will provide the most favorable flow conditions. As used herein, Reynolds number (Re) refers to:

$$Re = \frac{U \times W}{\nu}$$

where:

U = superficial velocity (total flow of fluid medium divided by cross sectional area of precipitator);

W = width of baffles; and $\gamma$ = kinematic viscosity of fluid medium.

The embodiment illustrated in FIG. 14 achieves the necessary flow characteristics. The minimum baffle width is dictated by cost of manufacture.

The next stages, generally indicated at 70 in FIG. 10, consists of one or more parallel plate electrostatic precipitator sections, each such section having an extended discharge section on the upstream and downstream sides thereof. The discharge electrode portions of said sections consist of discharge electrode assemblies 51' essentially identical with the assemblies 51' of the embodiment of FIGS. 5 and 6. Like collection plates 43'' are also provided as are discharge electrodes 44'''. The extended discharge section includes channel baffles 71 which are substantially identical with baffles 66 and arranged essentially in the same "opened" configuration. The baffles 71 are arranged so that the velocity along the plates 43' will be the minimum velocity of the velocity distribution behind the baffles. This will minimize the reentrainment, in that the velocity along the plates will be the smallest magnitude in the distribution. Generally, the spacing between baffles 71 exceeds the width of said baffles to minimize excursions of velocity from the superficial velocity as illustrated in FIGS. 14 and 15. The precise spacing, width and position of the baffles is dictated by the spacing between parallel plates 43''. Since medium excursion from the superficial velocity occurs in the region downstream of the baffles of the row closest to the parallel plates 43'', baffles 71 are positioned so that one of the baffles of said downstream row faces the leading edge of each collection plate 43''. For example, the baffles of FIG. 14 are particularly suited for a collection plate spacing of 12 inches.

The baffles 71 at the inlet to the extended discharge electrode and parallel plate sections have their flanges pointed downstream, while those at the exit end have their flanges pointed upstream. As shown in FIGS. 10 and 11, a vertically downwardly directed continuous spray from overhead nozzles 46'' cleans plates 43'. The open baffle configuration has a significant advantage in that about one half of the liquid from the horizontal sprays 68 pointing downstream ahead of baffle section 71 will penetrate through and effect washing on the back side of the baffles, on the discharge electrodes, and on the leading portions of plates 43'' where the amount of the dust particles collected is at its largest. Where more than one stage is provided, baffles of the "opened up" configuration would be provided as part of the extended discharge sections on the downstream side of each upstream parallel plate section and the upstream side of each downstream parallel plate section. Headers, similar to header 68, would be provided for spraying said baffles from between the two extended discharge sections. Said baffles would now be washed from above.

A set of transverse baffles 72 is positioned at the outlet of the parallel plate section as part of the last extended discharge section to capture dust and water drops escaping the parallel plate sections. Baffles 72 are relatively closed up with 2 inch spacing so that the second row overlaps the first for efficient collection.

Because of the diminishing loading of dust and gaseous contaminants in the gas as it moves through the wet electrostatic precipitator, a decreasing washing intensity downstream can be used. The nozzles 46'' direct water vertically downwardly from their positions above the parallel plates, as best seen in FIG. 11. The parallel plate section is more economical than the transverse section for removal of high loadings, those less than 0.5 grains/cubic foot, and of very small diameter, less than 1 micron particulates and condensed drops.

Figure 12:
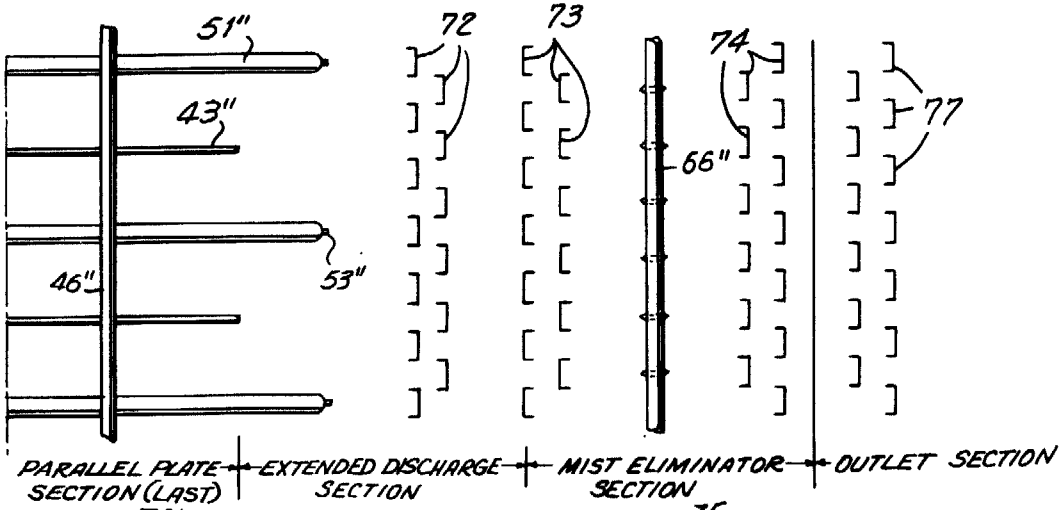
FIG. 12 is a plan view of the last parallel plate section, the mist eliminator section and the outlet section.

In any particulate and/or gaseous removal process where a liquid is used, it is very important to eliminate the carry over liquid drops and mists before the gas escapes through the exit duct of the apparatus, such as the stack 29. It has been found that effecting this elimination electrostatically is highly efficient, and the general arragement is shown in FIGS. 12 and 13. At the exit of the last parallel plate section after the extended discharge section, a transverse section consisting of discharge electrode assembly 66'' (substantially identical with assembly 66') and two sets of channel baffles 72 and 73 are provided. The baffles 72 should have a transverse spacing which is the same or less than the width of each baffle, so that, with a 2 inch wide baffle, a spacing of 2 inches or less will increase the removal efficiency. The spacing of the two rows from each other in the direction of flow is only 1 inch so as to minimize impact of drops against a baffle. The electrostatic field between the extended discharge electrode assemblies 66'' and baffles 73 and 74 aids the collection of escaping dust particles and liquid drops. It has been found by measurements that this configuration, without the electrostatic field, removes 95.6% of the liquid drops at a face velocity of 2.5 ft/sec. With the addition of the electrostatic field, the efficiency becomes substantially higher.

The transverse section, which is operated dry, establishes an electrostatic barrier which the small liquid drops cannot penetrate. The mist will collect on the back side of the upstream baffles 73 whose flanges extend in the downstream direction, while the downstream baffles 74, whose flanges extend in the upstream direction, will be essentially dry. However, some small dust particles can penetrate through and will collect on the downstream baffles 74. Consequently, the surfaces of these baffles should be washed intermittently to prevent build up of materials, and this is effected by intermittently operating the overhead nozzle 75 to wash the baffle.

A final set of channel baffles 77 whose flanges extend upstream, can be applied, as shown in FIGS. 12 and 13 for minimizing the so-called sweeping effect when the gas in the main housing converges toward the outlet duct or stack.

Figure 16:
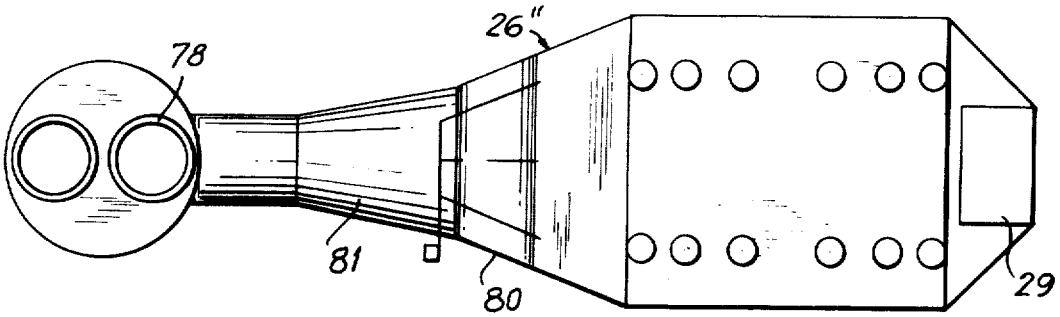
FIG. 16 is a plan view illustrating the precipitator embodying the invention as constructed and arranged for flyash and $SO_2$ removal from the discharge of a coal-fired boiler or steam generator.
Figure 17:
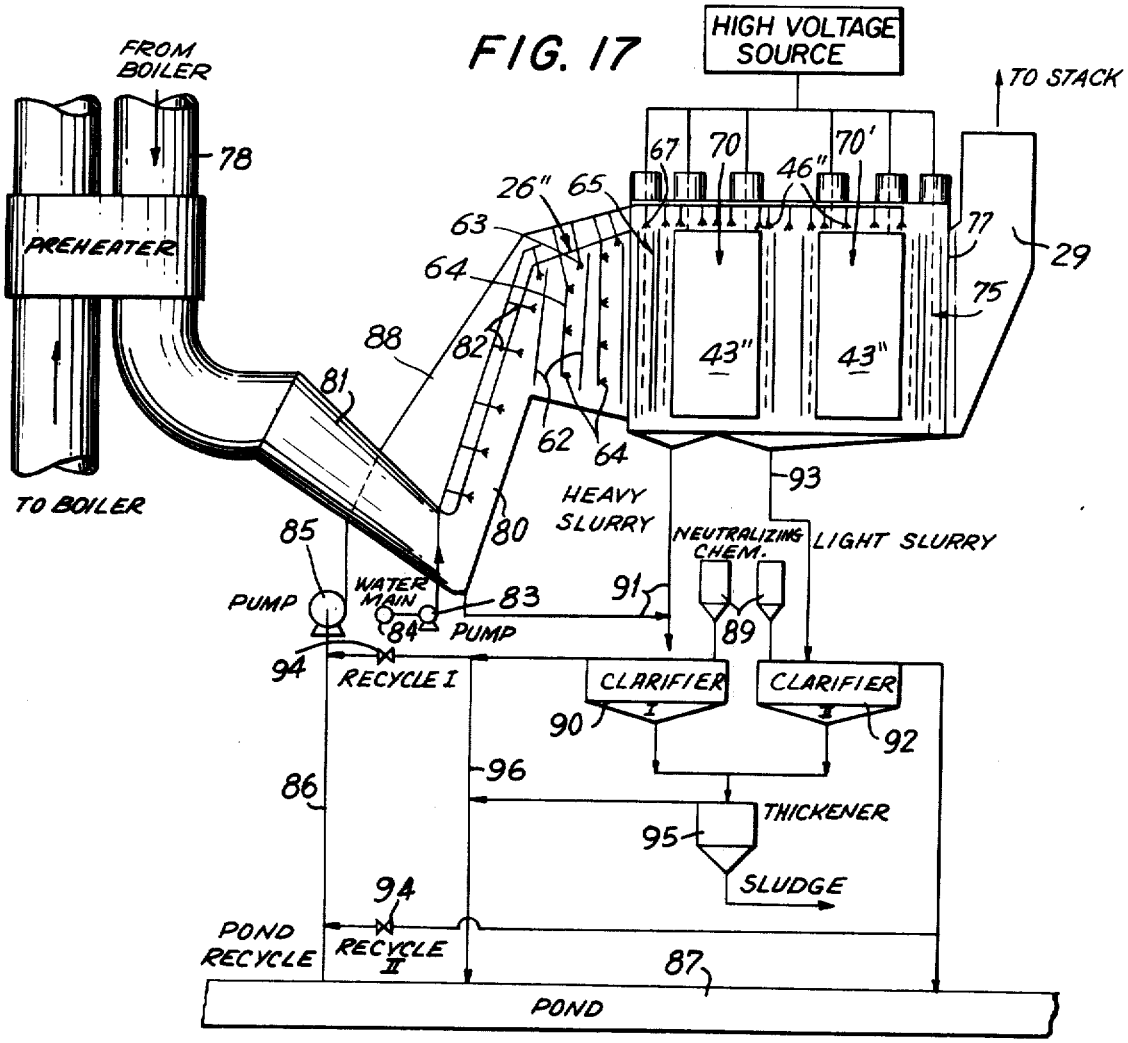
FIG. 17 is a schematic elevation view corresponding to FIG. 16.

The wet electrostatic precipitator of the invention can be used for simultaneous removal of flyash and $SO_2$ in a flue gas stream from a coal fired boiler, as shown in a general schematic manner in FIGS. 16 and 17. The flue gas is saturated by spraying water into the inlet duct which has an increasing cross section in the downstream direction of the gas flow. As shown in FIGS. 16 and 17, the gas from a conduit 78, leading from the boilers, is directed into a downwardly extending duct 81, and then upwardly into a spray section 80 where the gas is saturated. Saturation is effected by spray nozzles 82 supplied from a pump 83 connected to a water main 84. Some $SO_2$ is absorbed, and the gas is distributed over the inlet to the diffuser or inlet section 26'' which has the configuration shown in FIGS. 8 and 9. The spray nozzles 63 and 64 in inlet section 26'' are supplied with water from a pump 85 having an inlet line 86 communicating with a pond 87 and an outlet line 88 communicating with the nozzles 63, 64, 67 and 46''. The saturation process continues into the inlet diffuser which has the several rows of transverse baffles 62 which also take out some of the larger sized dust particles and act as flow distribution devices. The baffles are heavily washed, as indicated in FIG. 17, and $SO_2$ is being absorbed all the way through inlet diffuser 26''. Recirculated liquid is used for the washing, which makes more $SO_2$ absorption possible.

The gas and the flyash then enter into the first transverse electrostatic section 65 which is washed intensively and continuously. A substantial part of the flyash is removed here. The internals of transverse electrode section 65 are shown in FIGS. 10 and 11. More than one transverse section may be provided as dictated by the inlet loading of flyash. The flyash not taken out in the transverse electrostatic sections 65 passes through the baffles of the extended discharge electrode section and then onto the first plate section 70. Leaving the first plate section 70, the gas and the remaining particles pass through inter-plate section extended discharge sections for further flow distribution, flyash collection and $SO_2$ removal.

The gas then enters the next plate section 70' which may or may not be necessary, depending upon the collection area required for complete collection.

Flyash and $SO_2$ is continuously being removed and, since the concentration of both decreases in the downstream direction, the washing intensity, or the number of liquid spray nozzles, can be reduced in a downstream direction through the wet electrostatic precipitator.

When the clean gas is exiting from the last plate section, it again passes through an extended discharge electrode section 75. The last transverse electrode section is run dry and acts as a very efficient mist eliminator. The internals are shown, for example, in FIGS. 12 and 13. The cleaned and demisted gas then passes through some final baffles 77, which act as flow distributors, and the gas enters into the outlet duct 29.

The heavy slurry from the spray section 80, inlet section or diffuser 26'', the transverse discharge electrode section 65 and the upstream half of the first plate section 70 is supplied to a first clarifier 90 through lines 91. The light slurry from the latter half of the first plate section and from the following precipitator sections is supplied to a second clarifier 92 through a line 93. The water or liquid from clarifiers 90 and 92 is supplied with neutralizing chemicals at 89 and is delivered into pond 87 and also into line 86 through valves 94, for recycling. The discharge from clarifiers 90 and 92 is applied to a thickener 95 from which the sludge is discharged. The water from thickener 95 is supplied to a line 96 leading from clarifier 90 to pond 87.

It has been found that the maximum flyash removal is provided by a configuration including sections of "open" washed transverse baffles in the inlet or diffuser, to distribute the flow and to remove the largest flyash particles. These sections are followed by one or more sections of transverse electrostatic precipitators having transverse collecting baffles to remove a substantial portion of the coarse particles of the heavy inlet loading of 3–5 gr/cu. ft. presented to the wet electrostatic precipitator. Very intensive washing of these sections prevents build-up with the overall liquid consumption being from 20–50 gpm/1,000 cfm; with the actual value being dependent upon the dust inlet loading and the amount of $SO_2$ to be removed. Extended discharge sections serve for further removal of the heavy inlet loading and to collect dust and liquid drops that have not been collected in the parallel plate section or sections. The parallel plate sections, as required, are provided to remove the substantially lower loading of the finer particles in the flyash. The washing intensity is decreased in the downstream direction, since less and less particles are being collected due to the decreasing dust loading.

The use of the multiple troughs provides that the heavy flyash slurry in the front section of the unit and the lighter slurry from the rest of the unit can be separated and treated and/or recycled with varying degrees of clarification and filtration. With a wet electrostatic precipitator designed and operated as described above, there have been obtained very high migration velocities, since the collecting plates are washed heavily so that the particles are washed away and there is, therefore, no reentrainment or limitation due to dust resistivity.

Additionally, the apparatus shown in FIGS. 16 and 17 including the wet electrostatic precipitator embodying the invention effects simultaneous and highly efficient removal of flyash and $SO_2$ in one unit, with the use of continuous sprays from low pressure nozzles exposing a very large surface area of liquid which ensures excellent gas absorption. The use of a cross-flow scrubber configuration in the wet electrostatic precipitator provides fresh liquid througout the unit for $SO_2$ absorption, combined with long residence time of the droplets in the wet electrostatic precipitator which gives inherently sufficient time for efficient $SO_2$ absorption. The washed and wetted transverse baffles 62 in the inlet diffuser 26'', and througout the unit, act as $SO_2$ and liquid contact zones, and thereby enhance the absorption. The tortuous path the gas has to travel to pass these baffles increases the residence or contact time between $SO_2$ and liquid.

The apparatus has the potential for using all known $SO_2$ removal processes currently being used or tried in scrubbers, among which the following are exemplary:

A. The slurry neutralized externally with lime, $Ca(OH)_2$, filtered for flyash and precipitate, and then recycled.

B. The slurry neutralized externally with lime, coarse settling and recycling of light slurry.

C. The slurry filtered for flyash and calcium sulfite, then neutralized with the resulting $CaSO_3$ slurry recycled.

D. External neutralization with soda ash, filtration of flyash and recycling.

E. Dissolving ammonia in the charged liquid, filtration of flyash slurry and recycling of the liquid. Ammonia also can be injected directly into the gas.

F. Regenerative processes, such as ammonium and magnesium phosphate processing by filtering the slurry for flyash, regenerating the chemicals to recover the $SO_2$ gas, and recycling the liquid to the wet electrostatic precipitator.

It should be noted that those nozzles providing horizontally directed sprays may provide sprays in the form of full cones, while those sprays directing liquid vertically downwardly may provide sprays of a fan type. As an alternative, the saturation atmosphere in the chamber could be provided by steam rather than by water sprays.

The wet electrostatic precipitator embodying the invention can be used for simultaneous removal of aluminum oxides, solid fluorides, gaseous fluorides, tar mist and $SO_2$ from aluminum reduction cells. FIG. 7 schematically illustrates a general layout of a typical application for this purpose.

Figure 7:
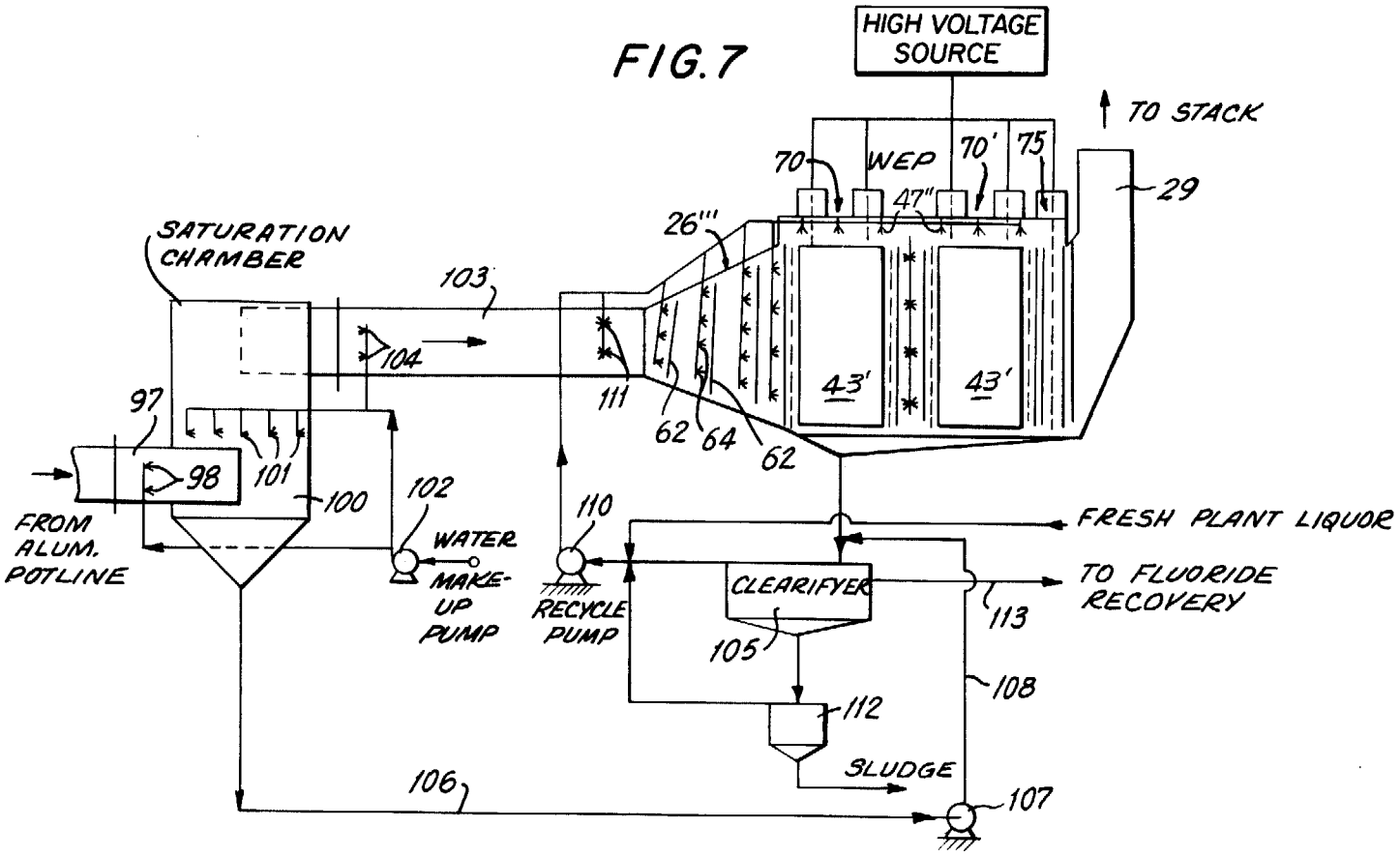
FIG. 7 is a schematic vertical sectional view illustrating a precipitator embodying the invention as used in association with the gaseous and particulate effluent from aluminum reduction cells.

Referring to FIG. 7, the stream of gaseous medium from the aluminum reduction cells is delivered through a conduit 97 into a saturation chamber 100. The arriving gas stream contains dust particles and mist of extremely small sizes. Due to the fact that small particles will take an electrostatic charge to the same degree as larger particles, the removal efficiency is very high. An equivalent removal efficiency in a scrubber would require extremely high pressure drops. Water is sprayed into the primary flue gas coming from the aluminum reduction cells by spray nozzles 98 in conduit 97 and by spray nozzles 101 in saturation chamber 100. Nozzles 98 and 101 are supplied with water from a water make-up pump 102, which also supplies water to spray nozzles 104 in a conduit 103 conducting the saturated primary gas from saturation chamber 100 to the inlet or diffuser section 26''' of the wet electrostatic precipitator. Inlet section 26''' has a construction identical with that of the inlet section 26'' shown in FIGS. 8 and 9, so that detailed description is believed unnecessary. The liquid accumulating in the hopper bottom of saturation chamber 100 is supplied through a line 106 to the inlet of a pump 107, whose outlet is connected by a line 108 to a clarifier 105.

A recycle pump 110 serves to supply nozzles 111 in conduit 103 adjacent inlet or diffuser section 26''', as well as to supply the nozzles 64 in diffuser 26''' and nozzles 47'' in plate sections 70 and 70'. The sludge from clarifier 105 is directed into a hopper 112 connected to a sludge removal line, and a line 113 connected to clarifier 105 leads to a fluoride recovery. As indicated in FIG. 7, recycle pump 110 is supplied with fresh plant liquor with water from clarifier 105 and with water from sludge settling hopper 112. The wet electrostatic precipitator includes collection plate sections 70 and 70' followed by a transverse discharge electrode section 75.

The primary flue gas coming from the reduction cells is saturated in a scrubber, such as the saturation chamber 100 or in the inlet or diffuser section 26''' of the wet electrostatic precipitator or both. All tar vapors must be condensed to a mist before the gas enters the main parallel plate section of the wet electrostatic precipitator, and a certain time with gas-liquid contact is needed in order to attain this. The gas passes through sections of "open" baffles 62, such as shown in FIGS. 8 and 9, before entering the main portion of the wet electrostatic precipitator. The inlet loading is usually very low, for example less than 0.1 gr/cubic foot and therefore a transverse electrode section is not necessary. The gas then passes through the sections 70 and 70' having the extended discharge sections at the inlet and outlet ends thereof, such as shown in FIGS. 11, 12 and 13, these sections having baffles in an "open" configuration, except for the baffles of the final extended discharge section.

After passing through a sufficient number of electrostatic fields to obtain the necessary removal efficiency, the gas passes through an extended discharge electrode section and a transverse discharge electrode section 75, such as shown in FIGS. 12 and 13. The latter section is provided for mist elimination, removal of tar drops and removal of dust particles escaping the last field of parallel plates, and said section is washed only intermittently.

Substantially the same results are obtained, with respect to removal of contaminates, by the arrangement shown in FIG. 7 as are obtained in the arrangement shown in FIGS. 16 and 17. Sufficient washing to maintain the internals in a clean state is provided with an overall liquid consumption of 5–12 gpm/1000 cfm of gas, with the inlet loading dictating the selection of the liquid to gas ratio. The arrangement of FIG. 7 provides simultaneous and highly efficient removal of fume particulates, gaseous fluorides and $SO_2$. It also has the potential for using alkaline liquids to increase the rate of removal of gaseous fluorides and $SO_2$ , and to improve the washing off of the collected tar.

The wet electrostatic precipitator embodying the invention can be used for simultaneous removal of condensed tar mist, coal particles and $SO_2$ coming from a carbon baking process, coke oven batteries or the like. Th schematic is essentially the same as shown in FIG. 7 for aluminum reduction cells, except that there are no aluminum oxides or fluorides in the gas stream and the tar loading is much higher. Consequently, full saturation of the gas stream with water vapor and the condensation of all tar vapors is very important prior to the entry of the gas into the main part of the wet electrostatic precipitator. Other applications of the wet electrostatic precipitator embodying the invention are possible, the examples herein given being merely by way of example.

It will thus be seen that the objects set forth above, among those made apparent from the preceding description, are efficiently attained and, since certain changes may be made in carrying out the method of operating the wet electrostatic precipitator and in the constructions as set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A wet electrostatic precipitator for use with a coal fired boiler having a flue gas outlet comprising, in combination, a housing having inlet and outlet openings; electrostatic field section means in said housing including a plurality of spaced, substantially parallel collection plates extending in a flow direction along a flow path, a plurality of discharge electrodes interposed in the spaces between said collection plates, and means applying an electric potential between said collection plates and said electrodes; a first plurality of relatively narrow and elongated baffles in said housing extending across said flow path in advance of said electrostatic field section means; a second plurality of relatively narrow and elongated baffles in said housing extending across said flow path downstream of said electrostatic field section means, said first and second pluralities of baffles each being arranged in successive groups spaced along the flow path, each group being arranged in at least two successive rows, the lateral spacing between the baffles in each row of said first plurality of baffles being greater than the width of the baffles, the lateral spacing between baffles in each of said second plurality of baffles being equal to or less than the width of the baffles, successive rows of said first and second pluralities of baffles being staggered laterally relative to each other; inlet means including said inlet opening and connected by said inlet opening to said flue gas outlet of a coal fired boiler and directing the flue gases, containing flyash and $SO_2$ to be precipitated, to flow between said collection plates along a flow path within said housing;means directing continuous sprays of washing liquid into the spaces between and against said collection plates; hopper means positioned below said electrostatic field section means and collecting therefrom a slurry formed of the washing liquid and the precipitated flyash and $SO_2$, said housing having openings communicating with said hopper means; clarifier means connected to said hopper means to receive the slurry therefrom; means supplying neutralizing chemicals to said clarifier means; said clarifier means separating the slurry into a sludge, containing the flyash, and a liquor; and a recycle pump operable to recycle the liquid to said spray means as the washing liquid to increase the effectiveness of $SO_2$ absorption by the washing liquid.

2. A wet electrostatic precipitator, as claimed in claim 1, including a source of make-up water and second spray means connected to said source of make-up water and positioned to direct sprays of water on said flue gas so as to saturate the flue gas entering said inlet means.

3. A wet electrostatic precipitator, as claimed in claim 1, including a second spray means in said inlet means connected to said recycle pump and positioned to direct sprays of liquid against the upstream surfaces of said first plurality of baffles; said hopper means being positioned below said inlet means.

4. A wet electrostatic precipitator, as claimed in claim 3, wherein said second spray means direct said liquor against the upstream surfaces of said first plurality of baffles in a direction extending substantially transversely to the flow path of said flue gas.

5. A wet electrostatic precipitator, as claimed in claim 3, wherein said second spray means is positioned to direct sprays of liquor against the upstream surfaces of said first plurality of baffles along a direction extending substantially parallel to the flow path of said flue gas.

6. A wet electrostatic precipitator, as claimed in claim 3, including at least one transverse electrostatic precipitator section in said housing positioned intermediate said first plurality of baffles and said electrostatic field section, said transverse electrostatic precipitator section including first and second groups of transverse baffles extending transversely across said flow path in spaced relation and further discharge electrodes positioned in the spaces therebetween.

7. A wet electrostatic precipitator, as claimed in claim 6, wherein said first and second groups of transverse baffles each include a plurality of relatively narrow and elongated baffles arranged in successive rows with the lateral spacing between the baffles in each row being in excess of the width of the baffles, and with the rows of baffles being laterally staggered relative to each other, and including third spray means connected to said recycle pump and directing continuous sprays of liquor against said transverse baffles.

8. A wet electrostatic precipitator, as claimed in claim 6, in which said hopper means includes a first hopper communicating with said inlet means, said transverse electrostatic precipitator section and the upstream portion of said electrostatic field section to collect a heavy slurry of washing liquid, flyash and $SO_2$, and a second hopper connected to the downstream portion of said electrostatic field section means and collecting a light slurry of washing liquid, flyash and $SO_2$; said clarifying means including respective clarifiers connected to said first and second hoppers; respective means supplying neutralizing chemicals to each of said clarifiers; means connecting each of said clarifiers to said recycle pump to supply clarified liquor thereto; a thickener hopper connected to both of said clarifiers and having a sludge outlet; and means connecting said thickener hopper to said recycle pump to supply clarified liquor thereto.

9. A wet electrostatic precipitator, as claimed in claim 6, including a mist eliminator electrostatic section positioned in said housing intermediate said electrostatic field section and said outlet opening for eliminating washing liquid mist from said gaseous medium.

10. A wet electrostatic precipitator, as claimed in claim 9, wherein said mist eliminator electrostatic section includes a transverse electrostatic precipitator section including first and second groups of transverse baffles extending transverse to the flow path in spaced relation therealong and further discharge electrodes positioned intermediate said first and second groups of transverse baffles.

11. A wet electrostatic precipitator, as claimed in claim 10, wherein said first and second groups of baffles of said mist eliminator electrostatic section include a plurality of relatively narrow and elongated baffles arranged in successive rows, with the lateral spacing between the baffles in each row being equal to or less than the width of the baffles and with the rows of baffles being laterally staggered relative to each other.

* * * * *